US005224605A

United States Patent [19]

Neilsen

[11] Patent Number: 5,224,605

[45] Date of Patent: Jul. 6, 1993

[54] METHOD AND APPARATUS FOR SEPARATING GRAVEL FROM BARK AND FOR CLEANING FINES FROM BOTH THE BARK AND THE GRAVEL

[76] Inventor: David A. Neilsen, P.O. Box 426, Placerville, Calif. 95667

[21] Appl. No.: 655,850

[22] Filed: Feb. 15, 1991

[51] Int. Cl.[5] ..... B03B 7/00; B03B 5/56

[52] U.S. Cl. ..... 209/17; 209/39; 209/156; 209/173

[58] Field of Search ..... 209/155, 156, 157, 173, 209/12, 17, 38, 39, 172, 172.5

[56] References Cited

U.S. PATENT DOCUMENTS

| | | | |
|---|---|---|---|
| 615,713 | 12/1898 | Johnson | 209/173 |
| 2,139,047 | 12/1938 | Tromp | 209/173 |
| 2,205,841 | 12/1935 | Young | 209/156 |
| 2,835,384 | 5/1958 | Tromp | 209/39 X |
| 2,990,064 | 6/1961 | Schoeneck | 209/156 |
| 3,367,495 | 2/1968 | Lea et al. | 209/163 |
| 3,682,299 | 8/1972 | Conley et al. | 209/17 |
| 4,055,488 | 10/1977 | Siri et al. | 209/173 |
| 4,169,787 | 10/1979 | Gunnerson | 209/173 |
| 4,245,553 | 1/1981 | Nakamura | 209/156 X |
| 4,375,264 | 3/1983 | Porter | 209/173 X |
| 4,813,618 | 3/1989 | Cullom | 241/79.1 |
| 5,049,260 | 9/1991 | Spears | 209/157 X |

FOREIGN PATENT DOCUMENTS

| | | | |
|---|---|---|---|
| 0325324 | 7/1989 | European Pat. Off. | 209/173 |
| 746341 | 6/1944 | Fed. Rep. of Germany | 209/172.5 |
| 43491 | 6/1934 | France | 209/172.5 |

*Primary Examiner*—Donald T. Hajec
*Attorney, Agent, or Firm*—Bernhard Kreten

[57] ABSTRACT

A method and apparatus for separating bark from gravel including first and second conveyors disposed within a trough having a first zone and a second zone maintained preferably at different liquid levels by virtue of a partition dam to provide cleansing of the bark and the gravel so that these substances have commercial vitality apart from each other.

27 Claims, 6 Drawing Sheets

METHOD AND APPARATUS FOR SEPARATING GRAVEL FROM BARK AND FOR CLEANING FINES FROM BOTH THE BARK AND THE GRAVEL

FIELD OF THE INVENTION

The following invention relates generally to a method and apparatus for separating bark from gravel and cleaning both the bark and the gravel from both unwanted debris and other contaminants such as fines so that both the gravel and the bark have subsequent commercial value.

BACKGROUND OF THE INVENTION

Solutions to problems which were satisfactory as recently as a few years ago may no longer provide viable alternatives. One such example involves recycling of bark as an unwanted by-product of the timber industry. Heretofore, much of the bark that devolves from harvesting timber and processing logs into lumber would have been relegated to a landfill. However, as available capacity in landfills diminish, other solutions must be found. In addition, concern has been expressed with respect to leaching of certain bark constituents such as tannins into ground water. Thus, relegating bark to a landfill is a less viable solution to the point where landfills will not allow bark. In fact some landfills presently do not accept bark.

Bark also has commercial value in other areas, such as when used for mulch, landscaping and fuel for cogeneration. However, commercially acceptable bark must be free from the debris which normally attends the processing, stock piling and transport of bark in bulk. For example, timber is typically stored in piles on a gravel surface and sprinkled with water to prevent decomposition and cracking from dehydration. The reason for the gravel surface is to support front end loaders which transport material from one pile to another. Contamination of the bark with gravel and fines, etc. result in the bark being unacceptable for commercial use.

A corollary to this problem involves the gravel itself. Gravel contaminated with bark is not commercially desirable either. Accordingly, a pressing need exists for clean bark and gravel which heretofore has gone unresolved.

The following patents reflect the state of the art of which applicant is aware and is tendered in direct response to discharge applicant's acknowledged duty to disclose relevant prior art. It is stipulated, however, that none of these citations when considered singly nor when analyzed in any permissible combination teach or render obvious the nexus of the instant application as particularly set forth hereinafter and as especially claimed.

| INVENTOR | PATENT NO. | ISSUE DATE |
|---|---|---|
| C. H. Young | 2,025,841 | December 31, 1935 |
| K. F. Tromp | 2,139,047 | December 6, 1938 |
| O. Schoeneck | 2,990,064 | June 27, 1961 |
| N. S. Lean, et al. | 3,367,495 | February 6, 1968 |
| Siri, et al. | 4,055,488 | October 25, 1977 |
| Cullom | 4,813,618 | March 21, 1989 |

The patent to Tromp is of interest since he teaches the use of an apparatus for separating materials having the greatest coincidental structural similarity with that of applicant's device. However, strictly speaking, this teaching in Tromp is to non-analogous, unrelated endeavors and therefore any similarities between the instant invention and Tromp are merely coincidental. Moreover, structural differences and methodologies are apparent from even a cursory comparison between the two. For example, Tromp does not contemplate directing bark over a dam-like partition in such a way that the bark will have undergone cleansing by virtue of the turbulence attending the travel of the bark over the dam partition.

No bark-gravel separator exists which will remove bark having a specific gravity equal to or greater than that of water.

The remaining citations show the state of the art further and diverge even more starkly from the instant invention.

SUMMARY OF THE INVENTION

The instant invention is distinguished over the known prior art in a multiplicity of ways. Specifically the instant invention separates bark from gravel even when the specific gravity of the bark is equal to or greater than the specific gravity of the water. In its most elemental form, the instant invention utilizes three conveyors in operative association with a trough filled with a liquid. The liquid, preferably water, resides in the trough in two zones: a first zone within which a first conveyor is deployed and a second zone preferably having a lower liquid level within which a second conveyor is deployed. The remaining conveyor feeds material into the trough over the liquid in the first zone. The disparity in volume of liquid between the first and the second zones can be varied depending upon the relative degree of impurities attending the bark. When the bark has the greatest amount of impurities, there is the greatest disparity between the liquid levels in the first and second zones. A dam partition separates the zones and, in conjunction with fluid current, creates turbulence as the bark migrates from the first zone to the second zone and tumbling after going over the dam at the bottom of a waterfall effect thereby facilitating cleaning.

This invention benefits from the differential in specific gravity between the gravel, fines, and the bark. The bark having a specific gravity less than that of the fluid will remain at a higher elevation in the fluid and float from the first zone to the second zone under the influence of a fluid current while the gravel sinks into the first zone. However, the remaining heavier bark and the gravel sink into the first zone but the fluid current influences only the heavy bark to migrate into the second zone. The first conveyor is strategically located within the trough in the first zone to convey the washed gravel out of the trough. The second conveyor is strategically located in the second zone to transport the washed bark out of the trough from the second zone. To a certain extent, the majority of fines remain in the trough, both in the first and second zones and are periodically purged from the system.

Additional enhancements to the system include anti-fouling means most predominantly operatively associated with all of the conveyors to enhance the continuous separation process with minimal down-time for system purging or cleaning. A first anti-fouling enhancement minimizes the transmission of certain unwanted debris at the input conveyor when feeding the trough. A second anti-fouling means provides cleaning for the conveyor which removes the bark. Third, the first conveyor in the first zone which removes the gravel is provided with other enhancements for removing unwanted metallic debris which frequently attends the process. Finally, a drain and conduit system are provided which allows the sediment within the trough to be periodically purged from the system.

OBJECT OF THE INVENTION

Accordingly, it is a primary object of the instant invention to provide a novel and useful method and apparatus for separating bark from gravel and from other unwanted contaminants.

A further object of the present invention is to provide a device as characterized above which is continuous in nature and therefore engenders a high through-put of material and therefore efficiency.

A further object of the present invention is to provide a device as characterized above which is extremely durable in construction, is safe to use and lends itself to mass production techniques. This therefore engenders great economies.

A further object of the present invention is to provide a device as characterized above which resolves the long standing, nettlesome, vexing and heretofore unresolved problem of removing unwanted contaminants from both gravel and bark so that each has independent vitality as a product for subsequent commercial use.

A further object of the present invention is to provide a device as characterized above which reduces the burden on existing landfills and therefore helps prevent ground water and aquifer contamination.

Viewed from a first vantage point it is an object of the present invention to provide a device which separates mixed substances such as bark and gravel from each other and cleaning both the gravel and the bark of fines and other contaminants such as metal. The device includes a trough, a dam in the trough which divides the trough into two zones including a first zone adapted to maintain a high water level and a second zone having a lower water level, a first conveyor disposed in the first zone of the trough having means to remove all of the mixed substances from the first zone except for the bark and some fines, a second conveyor in the second zone having means to remove the bark and some fines from the second zone and means to move the bark from the first zone into the second zone.

Viewed from a second vantage point, it is an object of the present invention to provide a separator which includes a trough which receives liquid therein, a partition in the trough which divides the trough into a first zone and a second zone, a first conveyor in the first zone, a second conveyor in the second zone, and drain structure adjacent the partition and located at a lower most portion of the trough in both the first and second zones to facilitate purging the trough.

Viewed from yet a third vantage point, it is an object of the present invention to provide a method for separating mixed substances based both on differentials of the specific gravity of the constituents forming the mixed substances and on surface characteristic differentials between gravel and heavier bark, the steps including dividing a trough into first and second zones, maintaining a liquid in each of the two zones at different levels, deploying the mixed substance into a first zone having a greater liquid level, inducing a current in the first zone and directing some of the liquid into the second zone, such that lighter substances flow into the second zone, causing heavier substances having a relatively large (compared to gravel) surface differential to migrate into the second zone and conveying the substances from the trough.

These and other objects will be made manifest when considering the following detailed specification when taken in conjunction with the appended drawing figures.

DESCRIPTION OF THE DRAWING FIGURES

Figure 12:
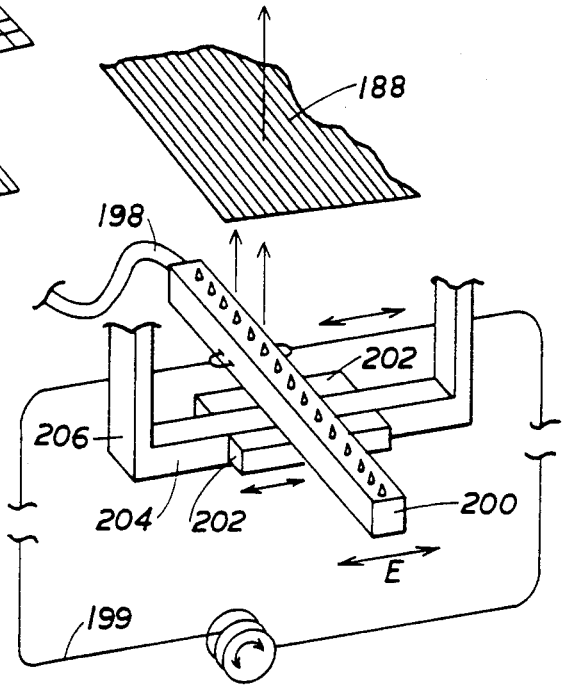
FIG. 12 shows greater detail of that which is shown in FIG. 11.
Figure 12A:
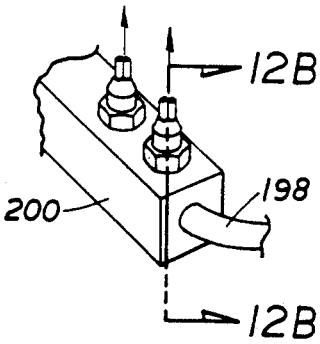

FIG. 12A further embellishes in perspective attributes of FIG. 12.

Figure 12B:
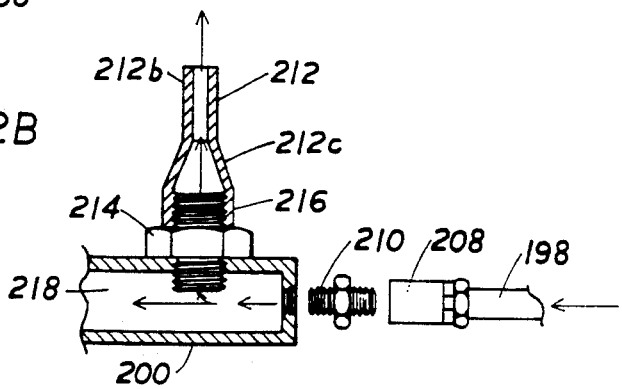

FIG. 12B is a sectional view along lines 12B—12B of FIG. 12A.

DESCRIPTION OF PREFERRED EMBODIMENTS

Considering the drawings now, wherein like reference numerals denote like parts throughout the various drawing figures, reference numeral 10 is directed to the separator according to the present invention.

Figure 10:
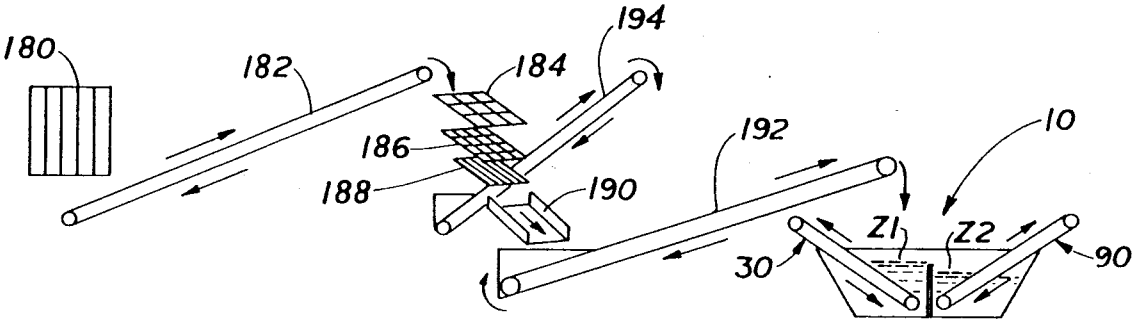
FIG. 10 is a schematic depiction providing an overview of the three conveyors in operative association with the trough according to the present invention.

In its essence, the separator 10 includes a dam formed from a dam-like partition 12 which divides a trough 20 into a first zone Z1 and a second zone Z2. The first zone receives input from an input conveyor 192 (FIG. 10)

and includes an output conveyor 30 therewithin. The other side of the dam 12 defines the second zone, remote from the input and first zone conveyor 30, and includes a second conveyor 90. Bark passing over the dam 12 is carried from the trough by the second zone conveyor 90. Gravel is removed from the trough by the first zone conveyor 30.

Figure 1:
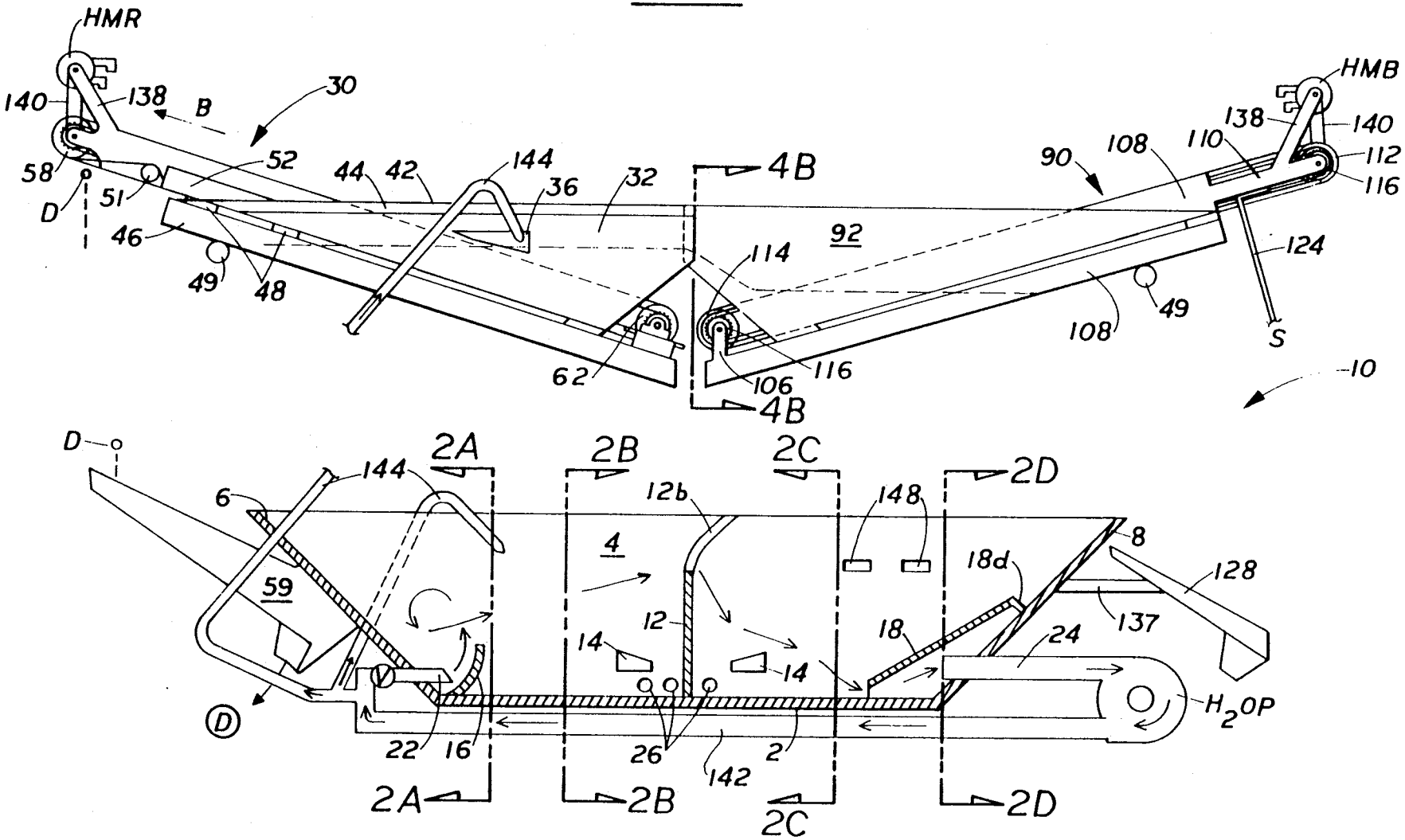
FIG. 1 is a side elevational view of the trough and the first and second conveyors according to the present invention.
Figure 2A:
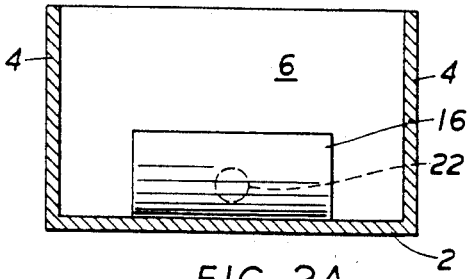
FIG. 2A is a sectional view taken along lines 2A—2A of FIG. 1.
Figure 2B:
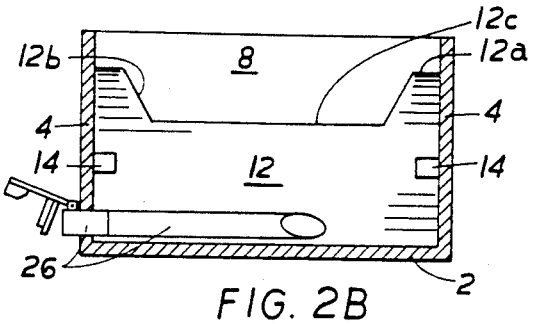
FIG. 2B is a sectional view taken along lines 2B—2B of FIG. 1.
Figure 2C:
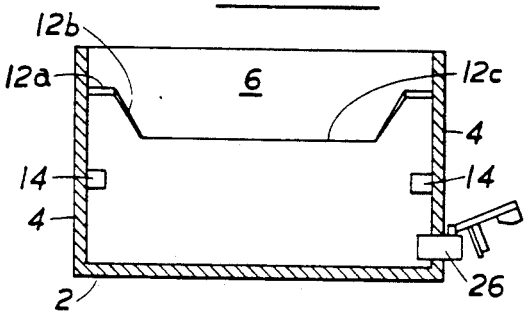
FIG. 2C is a sectional view taken along lines 2C—2C of FIG. 1.
Figure 2D:
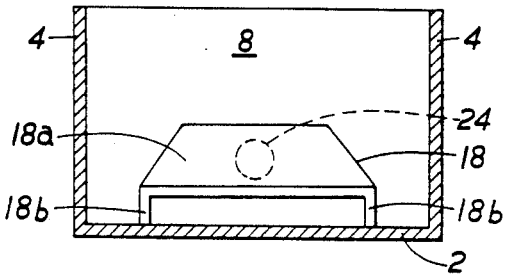
FIG. 2D is a sectional view taken along lines 2D—2D of FIG. 1.
Figure 2E:
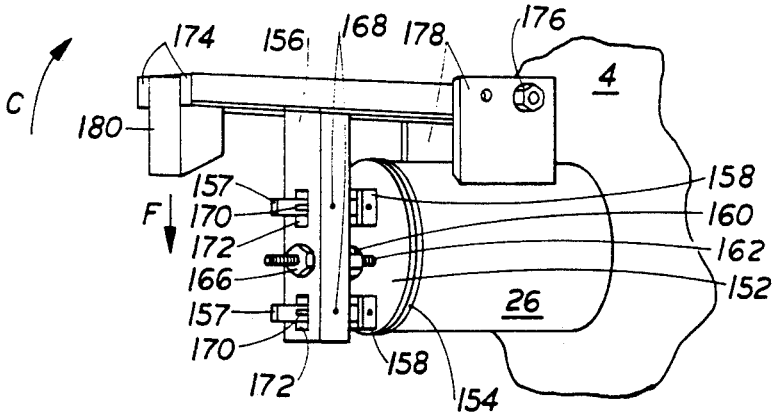
FIG. 2E is a perspective view of a drain shown in FIGS. 1, 2B and 2C.
Figure 3:
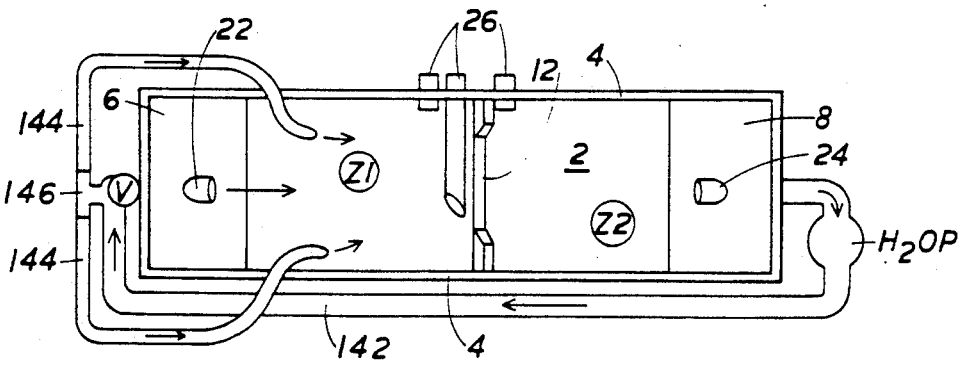
FIG. 3 is a top plan view of the trough shown in FIG. 1.

More specifically, and with reference to FIGS. 1 through 3, the structure of the trough 20 can be explored. In its essence, the trough includes a bottom wall 2 formed as a substantially rectangular blank that includes a first pair of spaced parallel side edges and a second pair of spaced parallel end edges orthogonally related to the side edges. These end edges communicate with upwardly extending side end walls 6, 8 which diverge upwardly and outwardly to form an inverted, isoceles trapezoid. The trough 20 is completed by two side walls 4 each extending orthogonally upward from the bottom wall 2 between the end walls 6, 8.

A dam type partition 12 is medially interposed between the end walls 6, 8, extending between the side walls 4 with a central portion extending perpendicularly up from the bottom wall 2. This dam 12 has a top most edge 12*a* canted towards the second zone 22, a centrally disposed lip 12*c* and a transition therebetween defined by a chamfer 12*b*. Note that the lip 12*c* constitutes approximately 80% of the horizontal expanse of the dam 12. Collectively, the trough with the dam divides the trough into the first zone Z1 (at the left-hand side of FIG. 1) and a second zone Z2 (on the right-hand side of FIG. 1).

The remaining trough structure includes lower conveyor supports 14 positioned proximate to the dam partition 12 near the bottom wall 2 for receiving and supporting conveyors to be described later. In addition, an arcuate water inlet baffle 16 is provided in the first zone which redirects incoming water to be further embellished upon. And finally, a water outlet shroud 18 is provided in the second zone to facilitate exit of the water from the trough. Notice also the presence of drains 26 on both sides of and adjacent the partition 12 whose purpose will become apparent in the ensuing description. The outlet shroud 18 redirects partially liquid to an outlet 24 while the inlet baffle 16 directs water from an inlet 22.

Figure 4A:
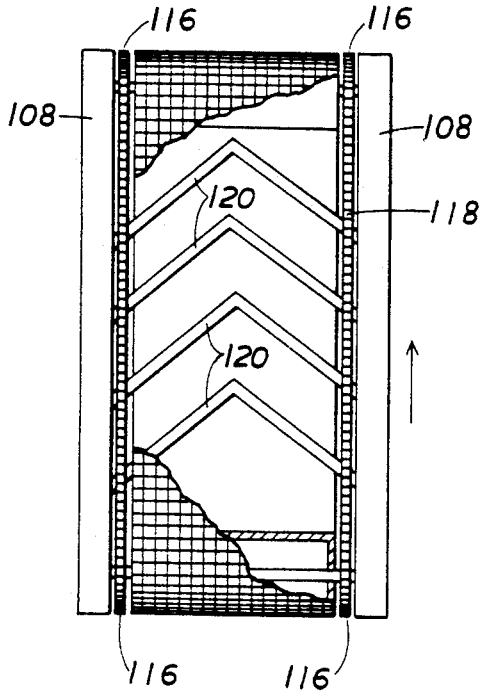
FIG. 4A is a top plan view of the second conveyor deployed on the right-hand side of FIGS. 1 and 3.
Figure 4B:
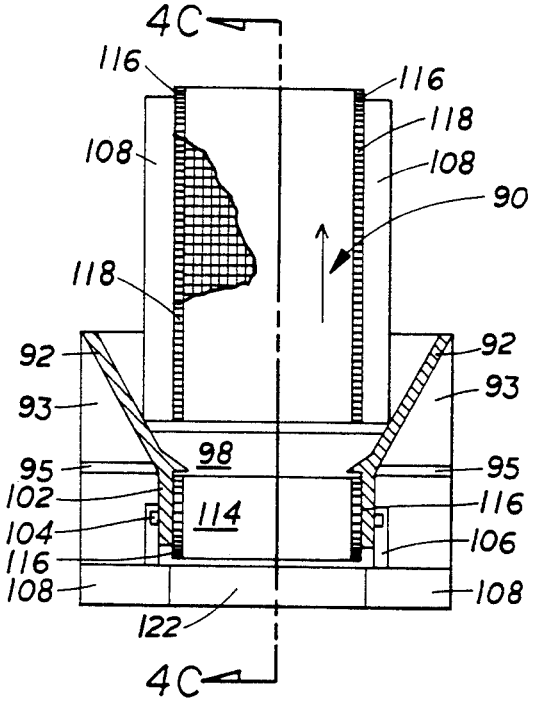
FIG. 4B is an end view of the FIG. 4A conveyor taken along lines 4B—4B of FIG. 1.
Figure 4C:
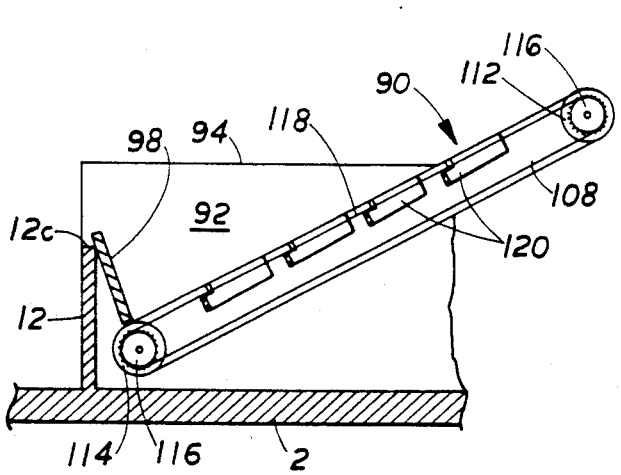
FIG. 4C is a longitudinal section along lines 4C—4C of FIG. 4B.
Figure 4D:
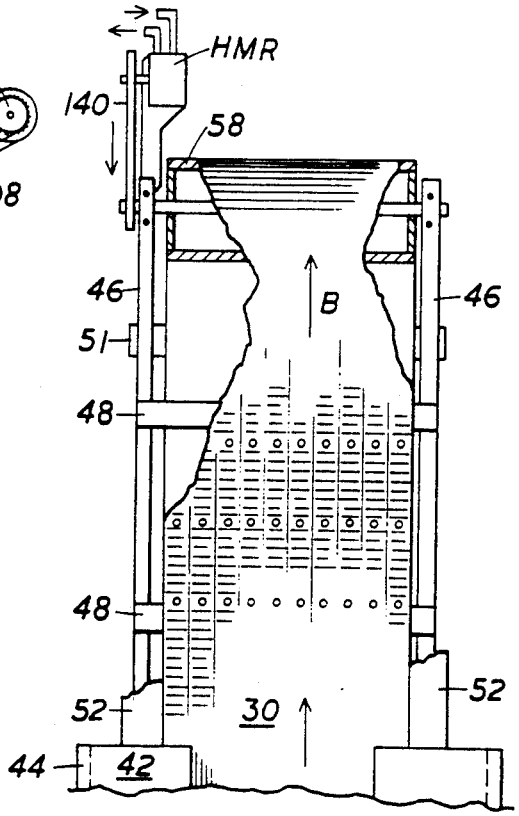
FIG. 4D is a top plan view of the first conveyor shown on the left-hand side of FIG. 1 partially fragmented for expositive clarity.
Figure 5:
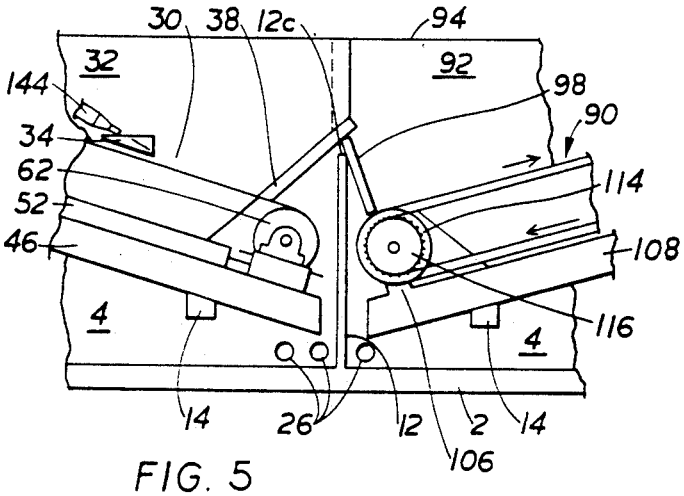
FIG. 5 is a detailed view of both the first and second conveyors at their lower most ends deployed within the trough.

With respect to FIGS. 1, 4D, 5 and 8, details of the conveyor 30 which is disposed within the first zone Z1 can now be explored. In essence, the zone one conveyor 30 includes a pair of spaced outwardly diverging chute side walls 32 extending upwardly girding either side of the conveyor 30. These chute side walls 32 include a water access 36 for purposes to be assigned. In addition, a chute lip 42 is provided which rests on the side walls 4 of the trough. The chute lip 42 includes a downturn 44 extending over an outer surface of the side wall 4 of the trough 20. FIG. 5 denotes a chute ledge 38 which extends between the chute side walls 32 at a lowermost portion of the conveyor and is oriented to overlie the lip 12*c* of the dam 12 and a ledge 98 of conveyor 90. The ledge 38 is upwardly and outwardly declinated towards the second zone and has a free end which overlies a second conveyor ledge 98 to be described infra.

The conveyor 30 shown in FIG. 4D includes a lower support frame formed from a pair of spaced parallel frame members 46 having transverse support ribs 48 extending therebetween. A lowermost portion of the conveyor frame 46 (at FIG. 5) rests on a pair of the lower conveyor supports 14. An upper extremity of the conveyor 46 also includes at least one downwardly depending tang 49 adapted to rest on a top edge of end wall 6. Collectively, these tangs 49 and lower conveyor supports 14 allow removeable support of the conveyor 30 in the first zone. The belt 30 may be perforated. The "return" half of the belt rides within a box 52 after passing over an idler 51 "downstream" from drive roller 58. The box 52 is carried on support ribs 48 which side on frame members 46. This structure causes the conveyor to move in the direction of the arrow B. The drive roller 58 is magnetized which causes metallic debris D to be carried on the underside of the conveyor where it is released on a skidway 59 and diverted away from the gravel pile. The belt past skidway 59 goes over idler 51 and into box 52.

Figure 8:
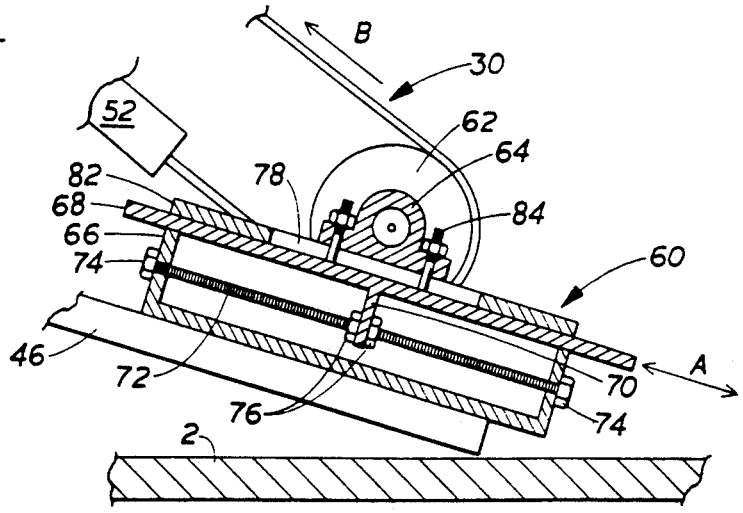
FIG. 8 shows an adjusting mechanism of a lower portion of the first conveyor.

The driven-roller 62 is carried on a support bearing 64 provided with a tension adjuster generally denoted as 60 and detailed in FIG. 8. More particularly, a tension adjuster box 66 is supported upon the frame 46. The box 66 includes a slide plate 68 adapted to move along the direction of the doubled-ended arrows A. An interior of the box 66 includes a threaded rod 72 having a pair of driven nuts 76 contained within the interior and straddling the threaded rod about a driven link 70 depending down from the slide plate 68. Driving nuts 74 on opposed extremities of the threaded rod 72 and outside the box allow the threaded rod 72 to be rotated thereby causing the driven link 70 to translate the slide plate 68 as discussed. The support bearing 64 which carries the driven-roller 62 is normally supported on a bearing plate 82 and held in fixed relation by means of tightening bearing bolts 84 such that the support bearing 64 wedges the bearing plate against the slide plate 68. However, by loosening the bearing bolts 84, and adjusting the driving nut 74, the support bearing 64 and therefore the driven-roller 62 can move along the length of a slot 78 formed within the bearing plate 82. This, therefore, adjusts the belt tension on the conveyor 30. Preferably, the adjuster box 66 is packed in grease for durability and to keep out the fluid.

With respect to FIGS. 1, 4A through 4C, 5, 6 and 7, aspects of the conveyor 90 oriented in the second zone Z2 can now be explored. More particularly, the conveyor belt 90 is made from mesh material allowing water to pass therethrough. The conveyor belt is supported by a structure quite similar to the conveyor 30 in that it includes a chute that allows the conveyor to be removed from the trough 20. The chute includes outwardly diverging side walls 92 fortified with a support gusset 93 having a support rib 95 to strengthen both the gusset and chute walls 92. The chute also includes a ledge 98 which extends between the side walls 92 at a lower most portion thereof and is adapted to register adjacent the dam 12 and overlie the top lip 12*c* of the dam partition 12. Notice the leading edge of ledge 98 underlies the ledge 38. This minimizes debris passing under ledge 98. The chute ledge 98 extends between the side walls 92 and allows a portion of the conveyor 90 to underlie it. Ledge 98 is an upwardly and outwardly (toward zone 1) declinated solid plate.

The chute may also include a skirt 102 extending down from the side walls 92. Unlike the side walls 92 the skirt is formed from two spaced, parallel, vertically-oriented plates which are adapted to straddle opposite sides of the conveyor and has a support axle 104 passing therethrough. The support axle 104 carries thereon a driven-roller 114. Interposed between the skirt 102 and the driven-roller 114 are a pair of sprockets 116 connected to a chain 118 and driven from a top drive-roller 112 at a remote extremity of the conveyor 90 outside of the trough 20. The drive-roller 112 and the driven-roller 114 are interconnected by a frame 108. More particularly, each frame 108 includes a tongue 110 extending towards and supporting the drive-roller 112. The tongue 110 may preferably include a threaded tensioning rod 72 similar to FIG. 8 to remove belt play but since this conveyor end is out of the water, no need for the protective grease box exists. At the lower end of conveyor 90, the pair of spaced parallel frame members 108 have upwardly extending axle supports 106 to carry the axle thereon. In addition, the frame 108 is held in spaced relationship by means of transverse braces 122 oriented along the length of the frame.

The frame 108 also supports a plurality of V-shaped support slats 120 interposed between the frame and underlying the belt of the conveyor 90 to provide support for the belt as it receives bark thereon. Stated alternatively, the V-shaped support slats 120 of the conveyor belt 90 keep the belt from sagging. Similar to the first conveyor 30 discussed above, the second conveyor has depending from an upper portion of the frame 108 a pair of downwardly depending tangs 49 (FIGS. 1 and 6) to support the conveyor upon the top edge of the end wall 8. The lower end of the conveyor finds the frame 108 supported on the lower conveyor supports 14.

Figure 6:
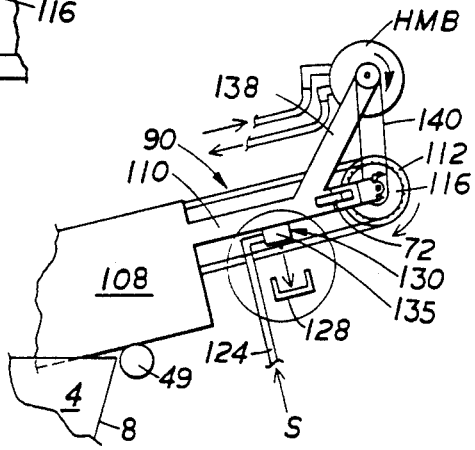
FIG. 6 shows detail of the second conveyor at the upper right-hand portion thereof.
Figure 7:
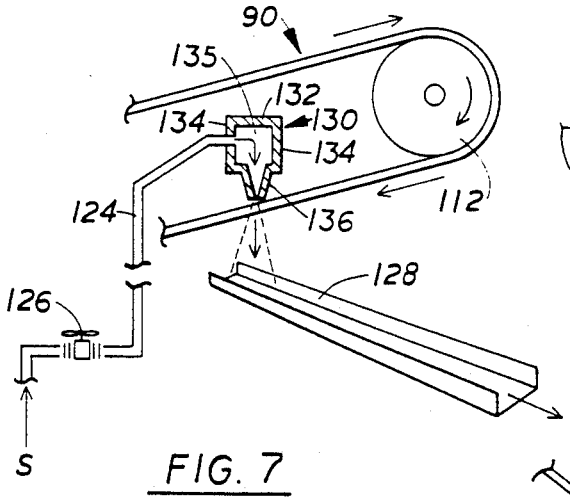
FIG. 7 is a diagrammatic depiction of certain attributes of FIG. 6.

With respect to FIGS. 6 and 7, one of the anti-fouling means is shown. More specifically, a water branch 124 directs water from a source S and into a tray 128 and is controlled by a valve 126. At an end of the branch 124 a water manifold 130 is adhered to an underside of the tongue 110 of frame 108. The manifold 130 is substantially box-shaped having a top wall 132, side walls 134, end walls 135 and a slit type nozzle outlet 136 that runs the width of the conveyor so that a ribbon of water is ejected therefrom and passes through the screen belt. In this manner, fine particulate matter, entrained in the screen conveyor 90, is removed from the conveyor and then deposited in the tray 128 where it is diverted transverse to the long axis of the conveyor 90 so that the fines entrained in the belt can be separately segregated. The tray is substantially U-shaped in section. As shown in FIG. 1, the tray 128 removeably attaches to the trough 20 by means of a bracket 137.

FIG. 6 also shows a drive mechanism for the conveyor 90, called HMB denoting a hydraulic motor for the bark conveyor. This motor has a motive source P,E (engine) shown in FIG. 9 and rotates the driving roller 112 by means of a chain 140. A similar arrangement exists for the first conveyor 30 and includes a hydraulic motor HMR for the rock conveyor (FIG. 1 e.g.) with a similar chain drive 140. Both hydraulic motors are suspended above both conveyors by means of a strut 138.

Figure 9:
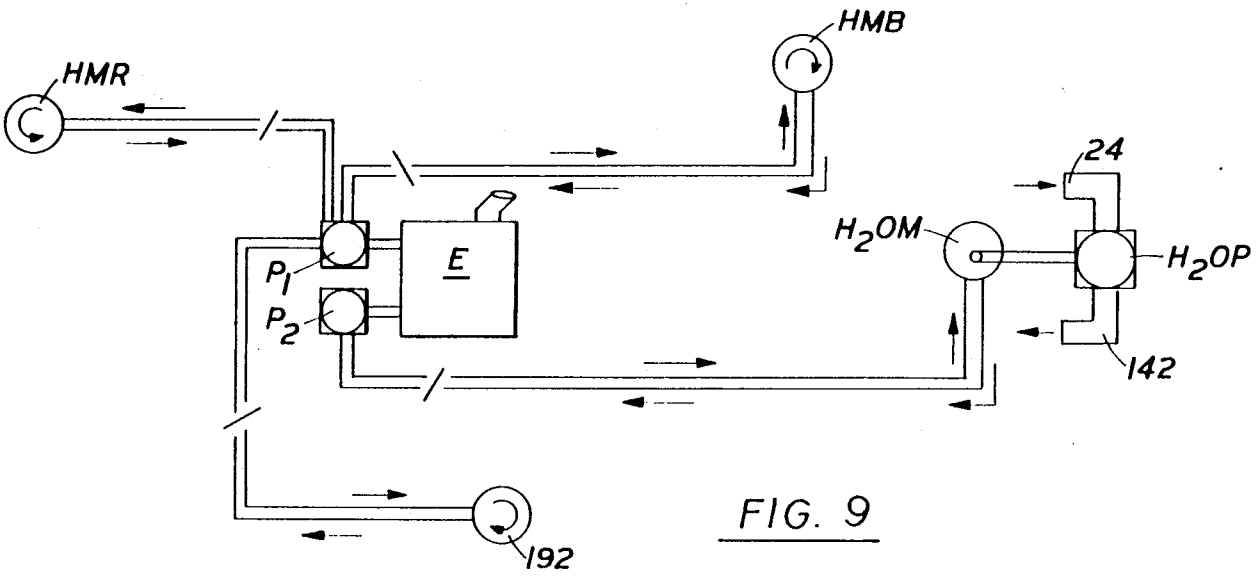
FIG. 9 shows a hydraulic circuit for operative association with the instant invention.

A hydraulic motor also is coupled to a water pump in FIGS. 1, 3 and 9 labeled $H_2O$ M and facilitates recycling the water in the trough 20. As shown in FIG. 3 for example, water leaving zone 2 through the outlet 24 is impelled from the tank by means of the $H_2O$ motor M. This water motor $H_2O$ M is interposed in a conduit 142 that returns the water from the outlet 24 to the inlet 22 and to a pair of branch passageways 144. Note the presence of a T adaptor 146 that taps into the conduit 142 providing two branch passageways 144 which are oriented as shown in FIGS. 1 and 3. A valve V distributes water to inlet 22 and branch passageways 144. In essence, these branch passageways 144 admit water through the water access 36 carried on the chute side walls 32. These branch passageways thus terminate adjacent the gravel conveyor 30 carried in zone 1 of the trough 20. The passageways 144 wash the gravel as it is being carried by the conveyor out and are located strategically just at the preferred operating level of the water in the first zone. Because the branch passageways direct water towards the dam partition 12, a strong fluid current is created which encourages the migration of the dark over into the second zone. This tendency of the bark to migrate to the second zone is further enhanced by the arcuate baffle 16 which initially directs water from the trough inlet 22 upwardly and towards the dam 12. The baffle 16 causes the fines near drains 26 to remain settled. The strong current causes "heavy" bark to climb up ledge 38 because the contour profile and surface area of the bark is greater than that of the gravel. Stated alternatively, the gravel provides a better hydrodynamic profile and continues to sink while the "heavy" bark is "blown" into the second zone up ledge 38.

This cleaning effect is also enhanced, not only by maintaining a liquid level differential between the first and second zones but also by providing the water trough outlet 24 with the outlet shroud shown in FIG. 1. In essence, and with reference to FIGS. 1 and 2D, the shroud 18 includes an end cap **18*d*, a top wall 18*a* and a pair of downwardly depending side walls 18*b* such that an inverted U-shaped structure in section is provided and it is located at the transition between the bottom wall 2 and the end wall 8 of the trough. Outlet 24 is also to a certain extent protected from undue contamination by means of the screen on the conveyor 90. Stated alternatively, because the screen 90 projects almost all the way to the dam 12 and because the ledge 98 laps under the ledge 38**, water must be filtered through this screen conveyor before reaching the outlet.

Sometimes, when the degree of debris associated with the bark is relatively minimal, the liquid in zone 1 and zone 2 can be substantially coincident (or the zone 2 level is even greater) so that there is minimal tumbling action present at the dam 12 as the bark is cleaned. Notice that drain openings 148 on a side wall 4 of the trough 20 in the second zone is provided to establish a maximum liquid level in the second zone slightly higher than the height provided by the lip **12*c*** of the partition.

In an analogous fashion, the water portal 36 is provided on the chute sidewall 32 of the zone 1 conveyor to allow the liquid to enter from passageways 144 and inlet 22 the conveyor 30. The effect is to provide a somewhat linear flow to push only floating and sinking bark to zone 2.

A final means for controlling the liquid level is provided by means of a plurality of drains 26, two of which are located in zone 1 adjacent the partition 12, one of which is located on an opposite side of the partition 12 in zone 2. As shown in FIG. 3, one of the two drains 26 in zone 1 (preferably the one closest dam 12) terminates substantially medially along the width of the trough. The two other "outboard" drains are stubbed into one of the side walls 4 and do not extend as deeply into the trough. This tends to take into account the migration pattern of the fines as they are deposited in the trough 20.

Since purging of these drains 26 occurs on an infrequent basis, a special valve may be associated therewith to trigger the draining process with a minimal amount of down time. FIG. 2E reflects the drain operating valve structure in detail. In essence, a flap 152 is provided with a seal 154 which occludes the drain's outlet outside the trough side wall 4. An arm 156 presses the flap against the drain 26 so that the seal 154 keeps water in. The arm needs to withstand the pressure head and flow effects of the water within the trough. Accordingly, a moment arm 174 is connected to the arm 156 at an upper end thereof. The moment arm 174 is pivoted at one extremity by means of pivot 176. The pivot 176 is supported on a pair of spaced parallel ears 178 extending up from the tubing of drain 26. At an extremity of the moment arm 174 remote from the ears 178 a counter balance weight 180 is supported so that a force F in a downward direction on moment arm 174 acts on the arm 156 retaining it in a closed position. The flap can easily be opened by merely overcoming the force F which has been calibrated to require minimal effort. Typically one attendant will periodically lift the weight 180 until the heaviest sediment will have been removed from the trough 20. The degree to which the seal 154 and flap 152 register with the drain 26 can be controlled by means of a pair of upper and lower posts 157 which are in sliding contact with the arm 156 by means of a pin 168 which allows the posts 157 to slide to a certain degree within slots 170 extending through the posts 158. In conjunction, the posts 157 reciprocate within the bore 172 fashioned in the arm 156. Thus, clearance can be provided properly aligning and providing pressure on the flap 152 via the posts 157. The posts 157 are supported on flap 152 by ears 158. Positive closure is provided by having a bolt 162 pressing against a central portion of the flap 152. The amount of pressure that the bolt 162 exerts on the flap 152 can be controlled by a nut 160 on an inner face of the arm 156 and is adjustable by means of the nut 166 which resides against an outer face of the arm 156. Thus, rotation of the moment arm 174 about the direction of the arrow "C" easily opens the drain valve 26 for purging.

Figure 11:
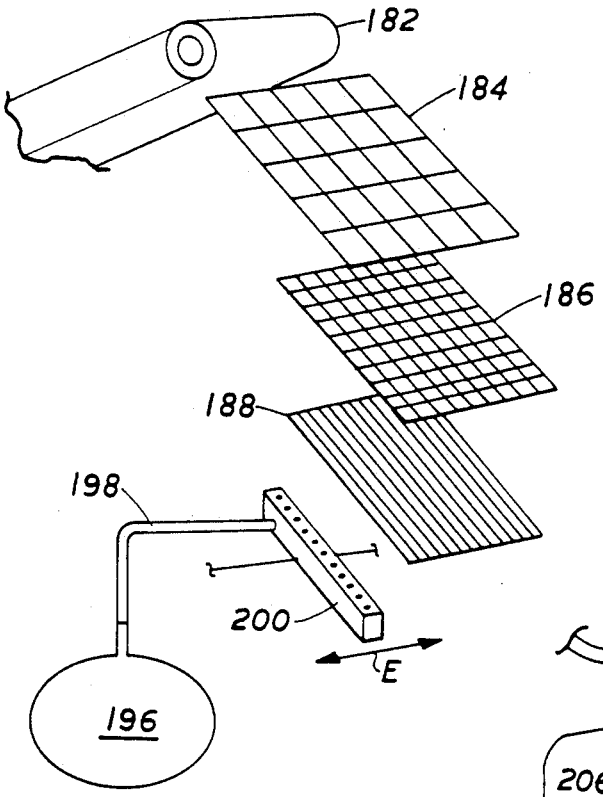
FIG. 11 is a perspective view of one attribute of a screening section which feeds the mixed substance into the conveyor which in turn feeds material into the trough.

With respect to FIG. 9, engine "E" directs and drives the hydraulic pumps P1, and P2 and is shown schematically. As suggested, branch passageways from the pair of pumps P1 and P2 are driven by the engine which in turn drive the appliances of the invention. The engine E, powering P1 affords power for the hydraulic motor HMR that drives the rock conveyor 30 and the motor HMB which operates the bark conveyor 90. In addition, the second pump P2 operates the water motor and pump $H_2O$ M and P in FIGS. 1 and 3. The first pump P1 also operates a conveyor 192 which is schematically shown in FIG. 10 and novel features are shown in FIGS. 11 and 12.

In actuality, the conveyor and its hopper immediately referred to are actually a series of conveyors and separators. Referring both to FIGS. 10 and 11, the sequence of feeding the trough 20 of the separator 10 in the first zone can be appreciated. A coarse grate 180 is angled so that a front end loader of the like throwing material thereon will cause the grossest material such as large rocks and wood chunks to slide off of the grate 180 and allow the smaller material on a conveyor 182. The conveyor feeds the material that passes through the coarse grate 180 onto an extremely coarse mesh 184. This mesh 184 is declinated so that the largest pieces roll away from the structure while the finer material passes through. A second, finer mesh 186 receives material passing through 184 and finally a harp screen 188 receives material which, when it rolls off, is directed on a tray 190 and then onto the conveyor 192 and then into the separator 10.

Material which is so fine that it passes through harp screen 188 is diverted away by means of a conveyor 194. Because of the nature of this operation, the harp screen 188 benefits from periodic purging so that the separator 10 can operate continuously with minimal down-time. A source of air 196, shown in FIG. 11, is directed to a manifold 200 through a conduit 198. Periodically the harp screen 188 is purged with the air by having the manifold 200 traverse the length of the harp mesh 188 and remove sediment from the mesh via air pressure. As shown, the harp screen 188 has a series of parallel strands and the manifold 200 has an elongate length parallel to these strands. The manifold 200 is constrained to operate in a linear direction E transverse to its long axis by a saddle 202 which straddles a support 204 carried on a frame 206 which supports screens 184, 186 and 188. Thus, reciprocation of the manifold 202 between the limits of this structure allows the harp screen to be cleaned. A draw rope 199 moves the manifold. As shown in FIGS. 12*a* and 12*b*, the conduit 198 may include a quick connect coupling 208 to a nipple 210 on the manifold 200 so that air can be admitted therethrough. A plurality of nozzles 212 are threaded into the manifold by means of nuts 214 and a threaded stem 216 so that air will communicate from within the manifold 218 outwardly. The nozzles 212 have a double needle-type output of figure "8" configuration and are tapered from a substantially conical configuration 212*a* to a cylindrical configuration 212*b*. Periodic purging using these various anti-fouling means discussed immediately supra extend the continuous operating nature of the apparatus.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A separator comprising, in combination:

a trough for receiving liquid therein, a partition in said trough which divides said trough into a first zone and a second zone, said partition including means to prevent access between said first zone and said second zone except over an upper edge of said partition, a first conveyor in said first zone having a ramp means which extends over said partition into said second zone, a second conveyor in said second zone, a fluid current entering into said first zone, traveling over said partition and into said second zone, carrying light debris therewith, and drain means adjacent said partition and located at a lowermost portion of said trough to empty said trough;

whereby heavy debris located in said first zone is carried up said first conveyor and light debris located in said first zone is carried via said ramp means and said fluid current over said partition into said second zone.

2. The separator of claim 1 wherein said partition is substantially medially disposed in said trough and the liquid in said first zone is maintained corresponding to a height of said partition and a fluid current means in said first zone induces current flow in said first zone.

3. The separator of claim 2 wherein said fluid current means includes at least one fluid inlet in said first zone and said second zone has a fluid outlet means for receiving liquid from said fluid current means.

4. The separator of claim 3 including means for limiting the amount of liquid in said second zone such that a level of said liquid in said second zone differs from said first zone.

5. The separator of claim 4 including anti-fouling means on said second conveyor, said second conveyor having a first portion within said trough and a second portion beyond said trough, said second conveyor including a conveyor belt formed from mesh material and said anti-fouling means is located at a portion of said second conveyor where it extends beyond said trough, said anti-fouling means including a spray of liquid which directs fine particulate contamination entrained on said mesh away from said conveyor.

6. The separator of claim 5 wherein said first conveyor has a first portion within said trough and a second portion beyond said trough, said first conveyor including a magnetic means on a portion of said conveyor which extends outside said trough and which diverts material having magnetic properties to a separate area.

7. The separator of claim 6 including an input conveyor which conveys material to be separated into said first zone, said input conveyor including preliminary separation means for removing an unwanted constituent prior to admission into the trough.

8. The separator of claim 7 wherein said preliminary separation means includes a fine mesh screen which separates fine particulate matter from the material to be conveyed by said input conveyor, and air nozzle cleaning means operatively associated with said fine mesh screen to purge said screen periodically by contacting said screen with a blast of air.

9. The separator of claim 1 wherein said first conveyor and said second conveyor are oriented to remove separated material in non-parallel directions.

10. A separator comprising, in combination:

a trough for receiving liquid therein, a partition in said trough which divides said trough into a first zone and a second zone, a first conveyor in said first zone, a second conveyor in said second zone, and drain means adjacent said partition and located at a lowermost portion of said trough to empty said trough, wherein said partition is substantially medially disposed in said trough and the liquid in said first zone is maintained corresponding to a height of said partition and a fluid current means in said first zone induces current flow in said first zone, wherein said fluid current means includes at least one fluid inlet in said first zone and said second zone has a fluid outlet mean for receiving liquid from said fluid current means, including means for limiting the amount of liquid in said second zone such that a level of said liquid in said second zone differs from said first zone, including anti-fouling means on said second conveyor, said second conveyor including a conveyor belt formed from mesh material and said anti-fouling means is located at a portion of said second conveyor where it extends beyond said trough, said anti-fouling means including a spray of liquid which directs fine particulate contamination entrained on said mesh away from said conveyor, wherein said first conveyor includes a magnetic means on a portion of said conveyor which extends outside said trough and which diverts material having magnetic properties to a separate area, including an input conveyor which conveys material to be separated into said first zone, said input conveyor including anti-fouling means for removing an unwanted constituent prior to admission to the trough, wherein said preliminary separation means includes a fine mesh screen which separates fine particulate matter from the material to be conveyed by said input conveyor, and air nozzle cleaning means operatively associated with said fine mesh screen to purge said screen periodically by contacting said screen with a blast of air, wherein said one fluid inlet in said first zone includes a first inlet placed on an end wall of said trough in said first zone which communicates with said trough by an arcuate baffle plate extending up from said end wall to thereby initially create an upward fluid migration pattern therewithin, and a pair of branch conduits in fluid communication with said inlet which diverts a portion of the liquid coming into said first zone by directing said liquid adjacent and upon said first conveyor near an upper surface of the liquid within said first zone, whereby said baffle and said pair of branch conduits ultimately induce unidirectional flow towards said second zone.

11. The separator of claim 10 wherein said branch conduits of said one fluid inlet include two water access holes formed in two chute side walls located adjacent each side of said first conveyor and extending upward therefrom.

12. The separator of claim 11 wherein said branch conduits of said one fluid inlet include two hoses, each hose having an inlet end provided with liquid from a source in fluid communication with said one fluid inlet and an outlet end positioned through one of said water access holes above said first conveyor to direct fluid from said one fluid inlet against said first conveyor.

13. An apparatus for separating from each other mixed substances with physical properties similar to bark and gravel, and cleansing the mixed substances of fines and metal, comprising, in combination:

a trough, a dam in said trough dividing said trough into two zones including a first zone adapted to maintain a high water level and a second zone having a low water level, said trough having an upper lip supporting a ledge sloping between a lower elevation location within said first zone to an upper elevation location above said low water level of said second zone, a first conveyor disposed in said first zone of said trough having means to remove all the mixed substances from the first zone except the substances with physical properties similar to bark and some fines, a second conveyor in said second zone having means to remove the substances with physical properties similar to bark and some fines from the second zone, and means to move the substances with physical properties similar to bark into the second zone.

14. A method for separating mixed substances based on both differentials in the specific gravity and surface area of the constituents forming the mixed substances, the steps including:

dividing a trough into first and second zones, maintaining a liquid in each of the two zones, deploying the mixed substance into the first zone, inducing a current in the first zone which directs some of the liquid into the second zone such that both lighter substances and heavier substances having a relatively large surface area flow into the second zone while heavier substances with a smaller surface area remain in the first zone, and conveying the separated substances from the trough, including dividing the trough by placing a dam-like partition between said first and second zones, and conveying the substances from the trough include lowering a conveyor into the second zone initially and orienting the second zone conveyor such that a ledge portion of the conveyor abuts a portion of the dam, placing another conveyor in the first zone such that another ledge on the first zone conveyor overlies the dam and the ledge portion, branching and orienting the current in the first zone such that some of the liquid comes in through an end wall of the trough and another stream of the liquid lands on the conveyor in the first zone, and removing liquid from the second zone.

15. A separator comprising, in combination:

a trough for receiving liquid therein, a partition in said trough which divides said trough into a first zone and a second zone, a first conveyor in said first zone, a second conveyor in said second zone, and drain means adjacent said partition and located at a lowermost portion of said trough to empty said trough, wherein said partition is substantially medially disposed in said trough and the liquid in said first zone is maintained corresponding to a height of said partition and a fluid current means in said first zone induces flow in said first zone, wherein said fluid current means includes at least one fluid inlet in said first zone and said second zone has a fluid outlet means for receiving liquid from said fluid current means, including means for limiting the amount of liquid in said second zone such that a level of said liquid in said second zone differs from said first zone, including anti-fouling means on said second conveyor, said second conveyor having a first portion within said trough and a second portion beyond said trough, said second conveyor including a conveyor belt formed from mesh material and said anti-fouling means is located at a portion of said second conveyor where it extends beyond said trough, said anti-fouling means including a spray of liquid which directs fine particulate contamination entrained on said mesh away from said conveyor, wherein said first conveyor has a first portion within said trough and a second portion beyond said trough, said first conveyor including a magnetic means on a portion of said conveyor which extends outside said trough and which diverts material having magnetic properties to a separate area, including an input conveyor which conveys material to be separated into said first zone, said input conveyor including preliminary separation means for removing an unwanted constituent prior to admission into the trough, wherein said preliminary separation means includes a fine mesh screen which separates fine particulate matter from the material to be conveyed by said input conveyor, and air nozzle cleaning means operatively associated with said fine mesh screen to purge said screen periodically by contacting said screen with a blast of air, wherein said one fluid inlet in said first zone includes a first inlet placed on an end wall of said trough in said first zone which communicates with said trough by an arcuate baffle plate extending up from said end wall to thereby initially create an upward fluid migration pattern therewithin, and a pair of branch conduits in fluid communication with said inlet which diverts a portion of the liquid coming into said first zone by directing said liquid adjacent and upon said first conveyor near an upper surface of the liquid within said first zone, whereby said baffle and said pair of branch conduits ultimately induce unidirectional flow towards said second zone.

16. The separator of claim 15 wherein said first conveyor is removeable from said trough and resides on an edge lip of said trough by means of a tang extending down from a bottom edge of said conveyor and hooking on a top edge of said end wall, and a lower conveyor support extends from side walls of said trough supporting a lower end of said conveyor.

17. The separator of claim 16 wherein said first conveyor includes a chute ledge which is upwardly and outwardly declinated towards said second zone which serves as a flow guide for heavy bark into said second zone and rests upon said partition.

18. The separator of claim 17 wherein said second conveyor includes means for removably attaching said conveyor in said trough for removing said second conveyor periodically and includes a ledge extending from a lower most portion of said second conveyor in underlying registry with said ledge of said first conveyor.

19. The separator of claim 18 wherein said liquid outlet is disposed on an opposite end wall of said trough remote from said inlet end wall and said outlet is disposed in said second zone, and said outlet is protected by means of a shroud of substantially U-shaped section admitting liquid substantially near a bottom wall area of said trough.

20. The separator of claim 19 wherein said second conveyor includes a plurality of slats underlying a top surface of said conveyor to prevent said conveyor from sagging.

21. The separator of claim 20 wherein said drain includes a flap valve formed with a gasket interposed between a drain pipe and a flap which precludes the through passage of liquid therebeyond, a flap arm contacting said flap and fastened thereto, and a moment arm connected to said flap arm provided with a counterbalance weight means, said moment arm adapted to move from a first to a second position and open said flap.

22. The separator of claim 21 including belt tensioning means for said first and second conveyors to maintain appropriate belt posture and both said first and said second conveyors include a chute surrounding side edges thereof.

23. A method for separating mixed substances based on both differentials in the specific gravity and surface area of the constituents forming the mixed substances, the steps including:

dividing a trough into first and second zones, maintaining a liquid in each of the two zones, deploying the mixed substances into the first zone, inducing a current in the first zone which directs some of the liquid into the second zone such that both lighter substances and heavier substances having a relatively large surface area flow into the second zone while heavier substances with a smaller surface area remain in the first zone, and conveying the separated substances from the trough, including dividing the trough by placing a dam-like partition between said first and second zones, and conveying the substances from the trough include lowering a conveyor into the second zone initially and orienting the second zone conveyor such that a ledge portion of the conveyor abuts a portion of the dam, placing another conveyor in the first zone such that another ledge on the first zone conveyor overlies the dam and the ledge portion, branching and orienting the current in the first zone such that some of the liquid comes in through an end wall of the trough first zone and another stream of the liquid lands on the conveyor in the first zone, and removing liquid from the second zone.

24. The method of claim 23 including purging portions of the mixed substances of both material too coarse for deployment into the first zone and material too fine for deployment into the first zone prior to deploying the mixed substance into the first zone and removing from the conveyor in the second zone fine particulate matter which has been imbedded in the conveyor, removing metallic material from the conveyor in the first zone by magnetically separating the metallic material at an end of the conveyor extending from the trough, and periodically draining sediment from the bottom of the trough.

25. A separator comprising, in combination:

a trough for receiving liquid therein, a partition in said trough which divides said trough into a first zone and a second zone, a first conveyor in said first zone having a ramp means which extends over said partition into said second zone, a second conveyor in said second zone, drain means adjacent said partition and located at a lowermost portion of said trough to empty said trough, and at least one fluid inlet for introduction of fluid into said first zone;

wherein said one fluid inlet in said first zone includes a first inlet placed on an end wall of said trough in said first zone which communicates with said trough by an arcuate baffle plate extending up from said end wall to thereby initially create an upward fluid migration pattern therewithin and direct fluid over said partition via said ramp into said second zone;

whereby heavy debris located in said first zone is carried up said first conveyor and light debris located in said first zone is carried via said ramp means and said fluid migration pattern into said second zone.

26. A separator comprising, in combination:

a trough for receiving liquid therein, a partition in said trough which divides said trough into a first zone and a second zone, a first conveyor in said first zone, a second conveyor in said second zone, drain means adjacent said partition and located at a lowermost portion of said trough to empty said trough, and at least one fluid inlet for introduction of fluid into said first zone;

wherein said one fluid inlet in said first zone includes a first inlet placed on an end wall of said trough in said first zone which communicates with said trough by an arcuate baffle plate extending up from said end wall to thereby initially create an upward fluid migration pattern therewithin, wherein said one fluid inlet in said first zone includes a pair of branch conduits in fluid communication with said one fluid inlet which diverts a portion of the liquid coming into said first zone by directing said liquid adjacent and upon said first conveyor near an upper surface of the liquid within said first zone, whereby said baffle and said pair of branch conduits ultimately induce unidirectional flow towards said second zone.

27. A separator for separating first heavy substances having a specific gravity much greater than water and a high density from second light substances having a specific gravity less than or slightly more than water having a lower density than the first substances, said separator comprising, in combination:

a trough including an interior supporting fluid therein, a dam-like partition within said trough dividing the fluid therein into isolated zones including a first zone and a second zone, a first conveyor in said first zone removing first substances from said first zone, a second conveyor in said second zone removing second substances from said second zone, said partition having an edge defined by a lip, a ledge located adjacent said lip which is a substantially flat ramp having an angled orientation causing a first edge of said ledge ramp nearer said first zone to be lower than a second edge of said ledge ramp which extends over said lip of said partition and into said second zone, and a current inducing means within said first zone which causes fluid in said first zone to pour over said ledge and said lip and into said second zone;

whereby the current separates a mixture of the first and second substances by causing the second substances to migrate up said ledge over said ramp and into said second zone, while the first substances remain in said first zone.

* * * * *